US006272993B1

(12) United States Patent
Cook et al.

(10) Patent No.: US 6,272,993 B1
(45) Date of Patent: Aug. 14, 2001

(54) ELECTRIC PRIMER

(75) Inventors: Todd D. Cook, Ekron; Dale R. Danner, Elizabethtown; John M. Dwyer, Jr., Crestwood, all of KY (US); Frances G. Lopata, Little Rock, AR (US); Diane Ronkainen, Hodgenville; David K. Schluckebier, Elizabethtown, both of KY (US); Robert B. Shanks, Little Rock, AR (US); Jeffrey W. Stone, Elizabethtown; Spencer D. Wildman, Prospect, both of KY (US)

(73) Assignee: R.A. Brands, LLC, Madison, NC (US)

( * ) Notice: Subject to any disclaimer, the term of this patent is extended or adjusted under 35 U.S.C. 154(b) by 0 days.

(21) Appl. No.: 09/648,301

(22) Filed: Aug. 24, 2000

Related U.S. Application Data

(62) Division of application No. 08/988,898, filed on Dec. 11, 1997, now Pat. No. 6,131,515.

(51) Int. Cl.[7] ..... F42B 3/14

(52) U.S. Cl. ..... 102/202.8; 102/202.1; 102/472

(58) Field of Search ..... 102/202, 202.1, 102/202.2, 202.5, 202.8, 202.9, 202.14, 204, 472

(56) References Cited

U.S. PATENT DOCUMENTS

| | | | | |
|---|---|---|---|---|
| H1245 | * | 10/1993 | Griswold | 102/206 |
| 800,056 | | 9/1905 | Bailey | 102/204 |
| 1,034,160 | | 7/1912 | Starkweather | 102/472 |
| 1,084,745 | | 1/1914 | Lindsay | 102/472 |
| 2,972,951 | | 2/1961 | Stresau | 102/472 |
| 3,018,732 | | 1/1962 | Tognola | 102/202.8 |
| 3,090,310 | | 5/1963 | Peet et al. . | |
| 3,288,631 | | 11/1966 | Gawlick et al. | 102/472 |
| 3,390,636 | | 7/1968 | Perkins et al. | 102/202.5 |
| 3,455,244 | | 7/1969 | Ballreich et al. . | |
| 3,499,386 | | 3/1970 | Stadler et al. | 102/472 |
| 3,779,167 | | 12/1973 | Irish, Jr. et al. . | |
| 3,783,788 | | 1/1974 | Hayashi | 102/202.1 |
| 3,844,216 | | 10/1974 | Jakobs et al. | 102/472 |
| 3,862,601 | | 1/1975 | Rentzsch et al. | 102/472 |
| 4,014,264 | | 3/1977 | Bendler et al. . | |
| 4,287,394 | | 9/1981 | Hargita et al. | 174/68.5 |
| 4,329,924 | | 5/1982 | Lagofun | 102/202.8 |
| 4,386,567 | | 6/1983 | Ciccone et al. | 102/202.5 |
| 4,464,990 | | 8/1984 | Bender et al. | 102/204 |
| 4,676,164 | | 6/1987 | Carter et al. | 102/204 |
| 5,027,707 | | 7/1991 | Mei | 102/202.8 |
| 5,044,278 | | 9/1991 | Campbell . | |
| 5,204,491 | * | 4/1993 | Aural et al. | 102/202.8 |
| 5,208,423 | | 5/1993 | Goetz . | |
| 5,361,702 | | 11/1994 | Goetz . | |
| 5,485,786 | | 1/1996 | Hesse et al. . | |
| 5,515,783 | | 5/1996 | Hesse et al. . | |
| 5,789,697 | * | 8/1998 | Engelke et al. | 102/202.5 |

OTHER PUBLICATIONS

PEEK™ manufacturer Victrex, Ltd., Material Properties, No date.*

Chang–Meng Hsiung, Mukerrem Cakmak, and James L. White Univer. Of Akron, Crystallization Phenomena in Injection Molding of Poly Ether Ether Ketone and Its Influence on Mechanical Properties, Aug. 1990, vol. 30 No. 16, pp. 967–980.*

* cited by examiner

*Primary Examiner*—Harold J. Tudor
(74) *Attorney, Agent, or Firm*—Womble Carlyle Sandridge & Rice, PLLC

(57) ABSTRACT

Electric primers for the discharge of ammunition suitable for use with small arms.

19 Claims, 1 Drawing Sheet

ELECTRIC PRIMER

CROSS-REFERENCE TO RELATED APPLICATION

This application is a division of application Ser. No. 08/988,898 filed Dec. 11, 1997 now U.S. Pat. No. 6,131,515.

BACKGROUND OF THE INVENTION

Electric primers have previously been used for the discharge of a variety of large military arms. With the development of electrically actuated firearms, it has been difficult to provide a primer that can be reliably activated by electrical current but without the risk of activation by undesired sources, such as electrostatic discharge, magnetic fields, electromagnetic radiation such as that emanating from electrical power lines and transformers and radio frequency transmitters while, at the same time, providing a primer of a size appropriate to small arms.

SUMMARY OF THE INVENTION

The present invention provides an electric primer of a size that can be used in small arms ammunition and which functions reliably with such ammunition.

Specifically, the instant invention provides an electric primer for small arms ammunition comprising:

(a) an electrically conductive cup having a bottom and an aperture in the bottom;

(b) an electrically conductive explosive within the cup;

(c) an electrically conductive contact positioned between the explosive and the bottom of the cup, and having a portion extending toward the aperture in the bottom of the cup;

(d) an insulating liner within the cup, separating the cup from the contact, the insulating liner being formed from polymeric material; and (e) a retaining means on top of the explosive; wherein the conductive explosive is configured to form an electrical path between the electrically conductive contact and the cup; and the insulating liner is configured and fit between the contact and the cup to retain the electrical contact within the cup after discharge of the explosive.

DETAILED DESCRIPTION OF THE INVENTION

Figure 1:
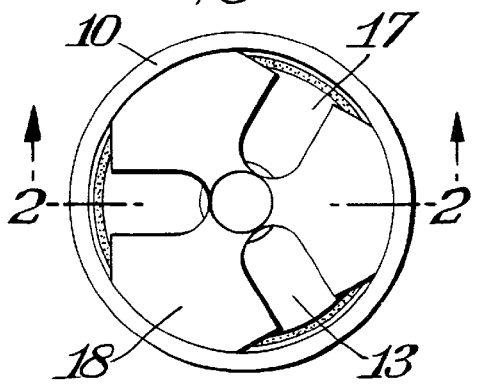
FIG. 1 is a top plan view of a primer of the present invention.
Figure 2:
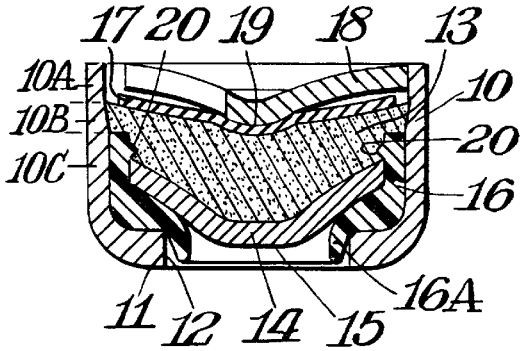
FIG. 2 is a cross-sectional view in elevation taken along line 2—2 of FIG. 1 of a primer of the present invention.

The present invention will be more fully understood by reference to FIGS. 1–4, which illustrate primers of the present invention. FIG. 2 shows a preferred primer in cross-section. There, an electrically conductive cup 10, having a bottom 11 and an aperture 12 formed in the bottom, contains electrically conductive explosive 13. As shown in that Figure, as well as FIGS. 3 and 4, the side walls of the cup are shaped to facilitate assembly of the primer. Specifically, in this preferred configuration, the upper portion of the side walls 10A are substantially straight, and the cup internal diameter has its greatest circumference at this point. Next, a tapered section 10B is provided to aid in the insertion of the components, followed by a second substantially straight section 10C. The cup can be prepared from a wide variety of conductive materials, of which brass is preferred.

The specific electrically conductive explosive should be selected for compatibility with the expected electrical input charge generated by the firearm. Particularly preferred explosives are those described in Shanks et al., U.S. Pat. No. 5,646,367, hereby incorporated by reference. The conductive explosive is configured to form an electrical path between the electrically conductive contact and the cup, either directly or through the retaining means. As shown in the drawing, a direct electrical path is provided, through the primer mix, between the contact and those portions of the cup not covered by the insulating liner, including through the retaining means, when a conductive retaining means is used.

Figure 3:
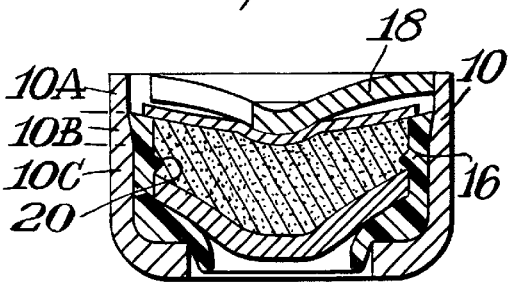
FIG. 3 is a cross-sectional view in elevation of an alternative primer of the present invention.

In an alternative embodiment, shown in FIG. 3, the insulating liner extends to the retaining means. In this case, the electrical path to the cup is through the retaining means and its conductive portions.

An electrically conductive contact 14 is positioned between the explosive and the bottom of the cup, and has a nipple portion 15 extending toward the aperture in the bottom of the cup. The nipple should substantially fill the aperture. Thus, upon firing, the contact is not substantially reshaped, and does not lose the original press fit attained on assembly. If a contact without a nipple portion were used, then the contact could reshape to the available space not supported by the firing pin and be reduced in diameter, losing the original press fit and permit undesirable gas leakage. The aperture formed in the bottom of the cup is of sufficient size to permit an electrode to contact the electrically conductive contact within the cup without touching the cup itself. As with the cup, a variety of conductive materials can be used, of which brass is preferred.

In the design and adaptation of the contact to the particular apparatus, the distance from the cup base to the nipple of the contact (h) which extends into the aperture formed in the cup bottom depends on the configuration and geometry of the system. Specifically, the minimum distance (h) required to avoid geometrically attracting an electrostatic discharge (ESD) arc from a source is related to the diameter of the aperture, the distance from the ESD source to the nipple contact and the radius of the ESD source, and is defined by the following equation:

$$h = R + L - \left( \frac{\sqrt{(2R + 2L)^2 - D^2}}{2} \right)$$

wherein R is the radius of the tip of the ESD source, L is the minimum distance from the source to the nipple contact and D is the diameter of the hole in the primer cup. Using this formula, assuming the worst case radius of the ESD source, the geometry of the cup assembly can be adjusted to ensure that an ESD source will always discharge to the grounded cup, thus avoiding an electrical current passing through the priming mix. The distance (h) of the design should always be deeper than the minimum calculated depth.

An insulating liner 16 is positioned within the cup, separating the cup from the contact. The thickness of the insulating liner will vary with the size of the primer and the electric potential to be supplied to the primer, as will be evident to those skilled in the art. The liner is preferably formed from polymeric material. In general, the insulating liner is prepared from at least one polymeric material having an Impact Toughness of at least about 1 ft-lb/in, a Heat Distortion Temperature at 264 psi stress of at least about 175° F., and a Modulus of Elasticity of at least about 130,000 psi, all as measured by conventional test procedures. A wide variety of polymeric materials can be used, including polypropylenes, polycarbonates, polysulfones, poly(ether imides), poly(amide imides), poly(ether sulfones), poly (benzimide azoles), and poly(ether ether ketones). Of these, the mechanical and electrical properties of poly(ether ether ketones) (PEEK) have been found to be particularly satisfactory, and these polymers are accordingly preferred for use as the insulating liners in the present invention. Poly(ether ether ketones) (PEEK) has the following performance characteristics, a Modulus of Elasticity greater than about 319,000 psi, a Heat Distortion Temperature at 264 psi stress of at least about 289° F., and an Impact toughness of at least about 1.12 ft-lb/in. In general, for those polymers having both a crystalline and an amorphous state, the amorphous state is preferred, since this generally provides better toughness while only slightly compromising heat distortion temperature and chemical resistance.

The insulating material preferably further comprises a minor amount of conductive material such as carbon to obtain a material resistivity of at least about 100 ohm-cm. This further increases the number of shunt current paths within the primer, that is, from the contact to the cup. This further decreases ESD sensitivity. The specific concentration of the conductive material will vary with the specific insulating material and the conductive material used, and should be sufficient to provide the desired conductivity but less than that which would depreciate the tensile properties of the polymer. Typically, higher concentrations of carbon fiber are needed to provide a desired level of resistivity than standard structure or high structure carbon black. In general, for the preferred PEEK polymeric materials, about from 0.5 to 60% of carbon can be used. For carbon fiber, about from 20 to 60% by weight is preferred for the desired resistivity. For standard structure carbon black, such as that commercially available from Cabot Corporation as Vulcan XC-72, about from 10 to 40% by weight can be used. With high structure carbon black, such as that commercially available from Akzo as Ketjenblack C-600 JD or from Degussa as Printex XE-2, about from 0.5 to 12% by weight can be used effectively.

In still another embodiment of the invention, an adhesive can be used for the insulating liner. While a wide variety of adhesives can be used for such insulating liners, these materials should be substantially free from amines, which would desensitize the high explosive in the primer. Epoxies have been found to be particularly satisfactory in this embodiment.

The insulating liner should be configured to substantially fully separate the electrically conductive contact and the electrically conductive cup, and have a portion 16A extending toward the aperture in the bottom of the cup. In one preferred embodiment of the invention, the insulating liner extends into the aperture, to provide a physical barrier to prevent conductive fouling, and short circuiting the contact and the cup, and to further ensure that the electric charge from the firing pin is directed to the contact and not to the cup. To aid in retaining the contact within the cup, the sides of the insulating liner are preferably provided with protrusions 20 formed on the sides of the liner.

The primer further comprises retaining means 17 on top of the explosive charge. The specific retaining means can vary widely, and can include one or more of lacquer, metallic or non-metallic foil, and an anvil press fit into the cup. Foils and lacquers which can be used can be conductive and non-conductive. For example, lacquer can be used alone or in combination with a metal foil. To provide a conductive lacquer, at least about 0.5% by weight of conductive filler, such as carbon fiber, can be admixed. If a conductive foil is used as the retaining means, the foil should preferably exhibit a resistivity of about from 1.5 to 12 microohm-cm at 20° C. In still another embodiment of the invention, the retaining foil is perforated. This provides the additional advantage of aiding drying during the manufacturing process.

When an anvil is used as a retaining means, the configuration can vary widely, and will be adjusted to the manufacturing and performance requirements of the particular construction. An important requirement is the provision of a path for the explosive brisance to reach the aperture in the shell adjacent the secondary charge. This can be, for example, a central aperture or circumferential notches or slots. For example, a disc with a central aperture can be used, and press fit into the cup. Another configuration is a trefoil, as shown in FIG. 1, which can also be press fit into the cup. In still another embodiment, a foil having a larger diameter than the cup can be press fit into the mouth. The gathered outside edges of the inserted foil will further aid in retaining the primer contents.

The configuration of the conductive contact and the retaining means is preferably adjusted so as to provide a substantially uniform distance between any point on the electrically conductive contact and the foil. The retaining means can, and preferably does, include an anvil 18 positioned over the foil or lacquer. The anvil can be press fit into the cup to aid in retention of the components after discharge of the explosive. In addition, or in the alternative, other means for retaining the positioning of the components after discharge include heat staking of the top rim of the insulator over the components in the course of manufacture, or providing protrusions on the inner surface of the insulator so that a contact can be snapped into the insulator and retained. Still another means for retaining the components includes providing a mouth on the insulator which, after assembly, is smaller than the components. This can be provided with a draft angle on the external diameter of the insulator, for example, of two degrees per side. After assembly, the material can be further moved radially inward to make the mouth of the insulator smaller than the contact diameter. This further facilitates retaining the components after firing.

The explosive should preferably be configured to provide substantially uniform distance between the contact and the retaining means. Accordingly, the explosive typically comprises a central depression 19 that generally conforms to the nipple portion 15 of the contact.

In the selection of materials and construction configuration, it is desirable to have a static impedance maintained as low as possible. In the preferred embodiments of the invention, using a conductive foil and an anvil, the impedance is about from 0.2 to 3 K ohms. In this manner, the sensitivity to ESD, magnetic fields, radio frequency transmitters and electromagnetic radiation can be significantly reduced. While this effect is not fully understood theoretically, it is believed that this results from multiple current paths through the explosive mix, which, in turn, results in lower currents in the respective current paths, and consequently reduced resistive heating, to a temperature below the initiation level.

Figure 4:
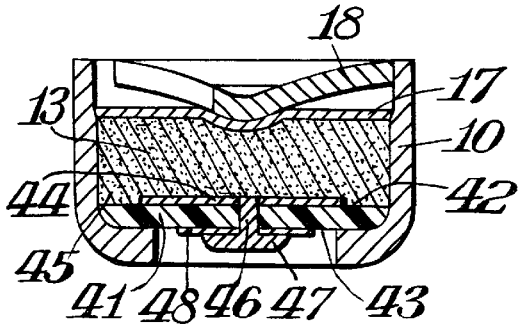
FIG. 4 is a cross-sectional view in elevation of a further alternative primer of the present invention.

A further alternative embodiment of the present invention is shown in FIG. 4, in which the contact and the insulator are combined. In that Figure, these elements are embodied in a single disc 41 in the bottom of the cup. The disc comprises top and bottom surfaces 42 and 43 a central conductive portion comprising top portion 44 and bottom portion 48. The bottom portion 48 is adjacent the aperture in the bottom of the cup, and is smaller in diameter than the aperture. The disc further comprises an annular portion 45 of electrically insulating material separating the cup from the central conductive portion. The central conductive portion is typically provided by plating areas on the top and bottom of the disc, and electrically connecting these areas by an aperture through the disc filled with conductive material 46, such as solder. The bottom of the conductive plating preferably further comprises a button 47 of conductive material such as solder.

Figure 5:
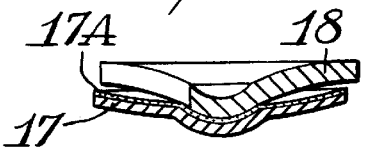
FIG. 5 is a partial cross-sectional view in elevation of an alternative embodiment of a primer of the present invention.

In the embodiment shown in FIG. 4, the basic disc can be fabricated from a wide variety of commercially available materials typically used for circuit board manufacture. The central conductive portion of the disc can be a metal or other conductive material, most typically nickel or copper. Still another embodiment of the present invention is shown in FIG. 5, in which a retaining means 17 is shown bearing a conductive lacquer 17A.

The primers of the instant invention can be reliably activated by electrical current without the risk of induced activation by undesired sources, such as electrostatic discharge, magnetic fields, electromagnetic radiation such as that emanating from electrical power lines and transformers, and radio frequency transmitters. In addition, the primers are of a size that can be used in small arms ammunition. There, the limited space is a critical design limitation. This provision of a primer small enough for use in sporting firearms was particularly difficult because of the restricted space available for an adequate primer charge, combined with the need to withstand the high operating pressures of the secondary charge. The invention can accommodate primers as small as the smallest primers currently used in sporting ammunition. The smallest-to-largest primer component volume required to fit inside the primer pocket of small caliber sporting ammunition constitutes 14% to 22%, respectively, of the volume of the smallest military electric primer (20 mm).

While specific embodiments are described in the foregoing specification, variations and modifications of the specific components and their combination will be evident to those skilled in the art.

We claim:

1. An electric primer for small arms ammunition comprising:

(a) an electrically conductive cup having an open top and a bottom having an aperture formed in the bottom;

(b) an electrically insulating liner within the cup, the liner formed from at least one polymeric material resistant to chemicals, having an Impact Toughness of at least about 1.12 ft-lb/in, a Heat Distortion Temperature at 264 psi stress of at least about 289° F., and a Modulus of Elasticity of at least about 319,000 psi;

(c) at least one electrically conductive explosive composition within the insulating liner and the cup;

(d) an electrically conductive contact positioned between the explosive and the bottom of the cup, the contact having a portion extending toward the aperture in the bottom of the cup; and (e) a retaining means on top of the explosive; wherein the liner is positioned to electrically insulate the cup from the contact, and wherein the liner has at least one means for retaining the electrically conductive contact within the cup after discharge of the explosive.

2. An electric primer of claim 1 wherein the retaining means comprises a foil.

3. An electric primer of claim 2 wherein the foil consists essentially of metal.

4. An electric primer of claim 3 wherein the configuration of the explosive and the retaining foil provide a substantially uniform distance between any point on the electrically conductive contact and the foil.

5. An electric primer of claim 3 wherein the retaining means further comprises a conductive retainer press fit into the cup on top of the foil.

6. An electric primer of claim 5 wherein the retaining means further comprises lacquer.

7. An electric primer of claim 3 wherein the insulating liner extends into the aperture in the bottom of the cup.

8. An electric primer of claim 3 wherein the retaining means further comprises a conductive anvil on top of the metal foil.

9. An electric primer of claim 2 wherein the retaining means further comprises a lacquer.

10. An electric primer of claim 2 wherein the retaining means further comprises an anvil press fit into the cup on top of the foil.

11. An electric primer of claim 1 wherein the retaining means consists essentially of lacquer.

12. An electric primer of claim 1 wherein the insulating liner comprises poly(ether ether ketone).

13. An electric primer of claim 12 wherein the poly(ether ether ketone) is substantially amorphous.

14. An electric primer of claim 1 wherein the insulating liner has an inner surface and the at least one means for retaining the electrically conductive contact within the cup after discharge of the explosive comprise projections formed on the inner surface.

15. An electric primer of claim 1 wherein the insulating liner further comprises conductive filler having a resistivity of at least about 100 ohm-cm.

16. An electric primer of claim 1 wherein the retaining means comprises a foil in combination with a lacquer having at least about 0.5% by weight carbon fiber.

17. An electric primer for small arms ammunition comprising:

(a) an electrically conductive cup having an open top and a bottom having an aperture formed in the bottom;

(b) an electrically insulating liner within the cup, the liner formed from at least one polymeric material resistant to chemicals, having an Impact Toughness of at least about 1.12 ft-lb/in, a Heat Distortion Temperature at 264 psi stress of at least about 289° F., and a Modulus of Elasticity of at least about 319,000 psi;

(c) at least one electrically conductive explosive composition within the insulating liner and the cup;

(d) an electrically conductive contact positioned between the explosive and the bottom of the cup, the contact having a portion extending toward the aperture in the bottom of the cup; and (e) a retaining means on top of the explosive comprising a lacquer containing at least about 0.5% by weight of carbon fiber; wherein the liner is positioned to electrically insulate the cup from the contact, and wherein the liner has at least one means for retaining the electrically conductive contact within the cup after discharge of the explosive.

18. An electric primer for small arms ammunition comprising:

(a) an electrically conductive cup having an open top and a bottom having an aperture formed in the bottom;

(b) an electrically insulating liner within the cup, the liner formed from at least one polymeric material resistant to chemicals, having an Impact Toughness of at least about 1.12 ft-lb/in, a Heat Distortion Temperature at 264 psi stress of at least about 289° F., and a Modulus of Elasticity of at least about 319,000 psi;

(c) at least one electrically conductive explosive composition within the insulating liner and the cup;

(d) an electrically conductive contact positioned between the explosive and the bottom of the cup, the contact having a portion extending toward the aperture in the bottom of the cup; and (e) a retaining means consisting essentially of lacquer comprising at least about 0.5% by weight of carbon fiber on top of the explosive;

wherein the liner is positioned to electrically insulate the cup from the contact.

19. An electric primer for small arms ammunition comprising:

(a) an electrically conductive cup having an open top and a bottom having an aperture formed in the bottom;

(b) an electrically insulating liner within the cup, the liner formed from at least one polymeric material resistant to chemicals, having an Impact Toughness of at least about 1.12 ft-lb/in, a Heat Distortion Temperature at 264 psi stress of at least about 289° F., and a Modulus of Elasticity of at least about 319,000 psi;

(c) at least one electrically conductive explosive composition within the insulating liner and the cup;

(d) an electrically conductive contact positioned between the explosive and the bottom of the cup, the contact having a portion extending toward the aperture in the bottom of the cup; and (e) a retaining means comprising a foil consisting essentially of metal and a lacquer having at least about 0.5% by weight carbon fiber on top of the explosive;

wherein the liner is positioned to electrically insulate the cup from the contact.

* * * * *